US008783331B2

(12) United States Patent
Heinecke et al.

(10) Patent No.: US 8,783,331 B2
(45) Date of Patent: Jul. 22, 2014

(54) SYSTEM AND METHOD FOR CASTING

(75) Inventors: Sven Heinecke, Hasselfelde (DE); Ingo Maerz, Wernigerode (DE); Holger Oppelt, Bad Suderode (DE); Roland Golz, Wernigerode (DE); Frank Landgraf, Weidling (AT); Alois Boindecker, Gurten (AT); Thomas Rathner, Ried im Innkreis (AT); Alexander Schneeberger, Ried im Innkreis (AT); Alois Wiesinger, Weibern (AT)

(73) Assignees: KSM Castings Group GmbH, Hildesheim (DE); Fill Gesellschaft m.b.H., Gurten (AT)

( * ) Notice: Subject to any disclaimer, the term of this patent is extended or adjusted under 35 U.S.C. 154(b) by 0 days.

(21) Appl. No.: 13/382,598

(22) PCT Filed: Jul. 7, 2010

(86) PCT No.: PCT/DE2010/000780

§ 371 (c)(1),
(2), (4) Date: Jan. 23, 2012

(87) PCT Pub. No.: WO2011/003396

PCT Pub. Date: Jan. 13, 2011

(65) Prior Publication Data

US 2012/0119461 A1 May 17, 2012

(30) Foreign Application Priority Data

Jul. 7, 2009 (DE) ..... 10 2009 032 148
Jul. 6, 2010 (DE) ..... 10 2010 026 293

(51) Int. Cl.
*B22D 18/04* (2006.01)
*B22D 18/06* (2006.01)

(52) U.S. Cl.
USPC ..... 164/253; 164/306

(58) Field of Classification Search
USPC ..... 164/61, 253, 254, 256, 306, 323, 119
See application file for complete search history.

(56) References Cited

U.S. PATENT DOCUMENTS 2,943,368 A * 7/1960 Peras ..... 164/295
4,671,342 A 6/1987 Balevski et al.

(Continued)

FOREIGN PATENT DOCUMENTS

DE 1 178 979 12/1961
DE 34 22 121 12/1985

(Continued)

OTHER PUBLICATIONS

Würker, L. et al., "Radführende Bauteile, hergestellt im CPC-Verfahren," vol. 92, No. 9, Jan. 1, 2005, pp. 30-35, XP009139013, ISSN: 0016-9765. (ISR).

(Continued)

*Primary Examiner* — Kevin P Kerns
(74) *Attorney, Agent, or Firm* — Collard & Roe, P.C.

(57) ABSTRACT

The invention relates to a system and a method for casting in which an upper casting mold half can be pivoted out of a horizontal position into an approximately vertical position, in such a manner that the inside surface of the casting mold half can be treated in work-facilitating and time-saving manner, preferably by a person.

24 Claims, 3 Drawing Sheets

(56) References Cited

U.S. PATENT DOCUMENTS

Figure 1:
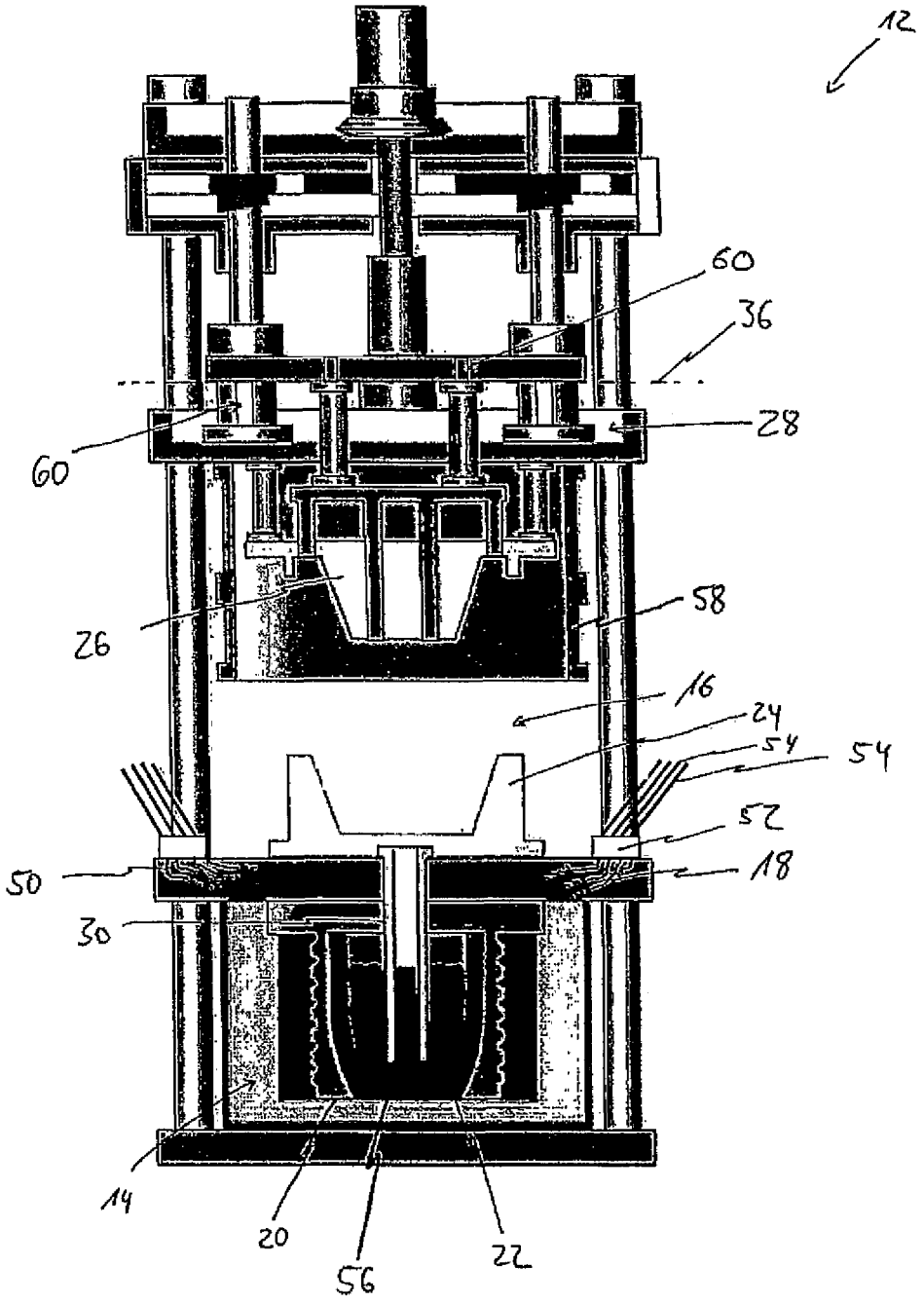

| | | | | |
|---|---|---|---|---|
| 4,825,772 | A | 5/1989 | Jeffreys | |
| 5,398,750 | A * | 3/1995 | Crepeau et al. | 164/154.2 |
| 8,083,244 | B2 | 12/2011 | Buschjohann et al. | |
| 8,302,979 | B2 | 11/2012 | Buschjohann et al. | |
| 8,333,395 | B2 | 12/2012 | Buschjohann et al. | |
| 8,403,347 | B2 | 3/2013 | Eickmann et al. | |
| 2005/0224145 | A1 | 10/2005 | Laslaz et al. | |
| 2008/0296812 | A1 * | 12/2008 | Jung et al. | 266/215 |
| 2010/0288401 | A1 | 11/2010 | Hennings et al. | |
| 2012/0104739 | A1 | 5/2012 | Buschjohann et al. | |
| 2012/0119461 | A1 | 5/2012 | Heinecke et al. | |
| 2013/0033017 | A1 | 2/2013 | Buschjohann et al. | |
| 2013/0168939 | A1 | 7/2013 | Buschjohann et al. | |
| 2013/0175780 | A1 | 7/2013 | Eickmann et al. | |

FOREIGN PATENT DOCUMENTS

| | | | | |
|---|---|---|---|---|
| DE | 20 2008 017 274 | | 4/2009 | |
| DE | 10 2008 055 928 | A1 | 8/2009 | |
| DE | 10 2010 026 480 | A1 | 3/2011 | |
| EP | 0 221 196 | | 5/1987 | |
| EP | 0 253 692 | | 1/1988 | |
| EP | 0 398 168 | | 11/1990 | |
| EP | 0 564 774 | | 10/1993 | |
| EP | 1 270 114 | | 1/2003 | |
| EP | 1 733 823 | | 12/2006 | |
| GB | 989353 | | 4/1965 | |
| GB | 1 471 882 | | 4/1977 | |
| JP | 61-235042 | A * | 10/1986 | B22C 25/00 |
| WO | 2007/031060 | A1 | 3/2007 | |
| WO | 2009/059591 | A2 | 5/2009 | |
| WO | 2009/059592 | A2 | 5/2009 | |
| WO | 2011/003387 | A1 | 1/2011 | |
| WO | 2011/003388 | A1 | 1/2011 | |
| WO | 2012/059078 | A2 | 5/2012 | |

OTHER PUBLICATIONS

English translation of the International Preliminary Report on Patentability and Written Opinion of the International Searching Authority of PCT/DE2010/000780, Jan. 19, 2012.

International Search Report of PCT/DE2010/000780, date of mailing Dec. 12, 2010.

DIN 50125, Jul. 2009, pp. 1-14.

DIN EN 10 002, 1990-1991, total of 29 pages.

International Search Report of PCT/DE2012/000240, mailed Aug. 22, 2012, four pages.

* cited by examiner

SYSTEM AND METHOD FOR CASTING

CROSS REFERENCE TO RELATED APPLICATIONS

This application is the National Stage of PCT/DE2010/000780 filed on Jul. 7, 2010, which claims priority under 35 U.S.C. §119 of German application Ser. No. 10 2009 032 148.9 filed on Jul. 7, 2009, and German application Ser. No. 10 2010 026 293.5 filed on Jul. 6, 2010, the disclosures of each of which are incorporated herein by reference. The international application under PCT article 21(2) was not published in English.

The invention relates to a system for casting, as well as to a method for casting.

Such systems, having a casting apparatus, particularly for casting under a pressure produced by means of a gas phase, are used in foundry technology, particularly for the production of cast pieces having great physical and mechanical characteristic values, particularly made of light-metal alloys.

A pressure-casting method is known from DE 1178979 A, in which a melt is conveyed, under the effect of a pressure difference, from a furnace situated in a hermetically sealed feed chamber, through a casting pipe, into the cavity of a casting mold, whereby the casting mold is disposed in another hermetically sealed equalization chamber. The cast piece solidifies in the equalization chamber, at the temperature present there, and at the pressure present there. Subsequently, the finished cast piece is removed from the casting mold, and a new casting cycle can be carried out.

The counter-pressure die-casting method known to a person skilled in the art, also known as the CPC (Counter Pressure Casting) casting method, is a further development of the so-called low-pressure casting method, and is known from various documents, for example from EP 0 221 196 B1, EP 0 564 774 B1, or DE 34 22 121 A1.

However, in contrast to the low-pressure casting method also known to a person skilled in the art, compressed gas is applied not only to the casting furnace but also to the die or casting mold.

The actual casting process takes place, both in the low-pressure casting method and in the counter-pressure die-casting method, using a riser through which the melt is conveyed upward into the die.

However, in the case of the counter-pressure die-casting method, application of pressure to the melt in the furnace, for conveying the melt upward into the die, is brought about by means of a pressure difference, in that the gas pressure in the die is lowered slightly. As a result, an excess pressure occurs in the casting furnace, which pressure is sufficient for causing the melt to rise into the die.

It is a disadvantage of the known systems that some work steps, which are not directly connected with the actual casting process, are very labor-intensive. Furthermore, the change-over times, particularly for changing the casting mold or for recharging a furnace with melt, are relatively long.

The invention is therefore based on the task of making available a system, particularly a counter-pressure die-casting system or, in particular, a low-pressure die-casting system, and a method for the production of cast pieces by means of casting under pressure, particularly by means of counter-pressure die-casting or, in particular, by means of low-pressure die-casting, in which the degree of automation and the regulation quality of the system and of the method, and thus the productivity, can be increased. Furthermore, the change-over times are supposed to be shortened and labor-intensive steps are supposed to be facilitated, in order to thereby achieve an increase in productivity.

In this connection, "casting under pressure" is supposed to be understood to mean casting under or at an excess pressure, normal pressure, or partial vacuum, whereby one or more of these casting methods can be advantageous, depending on the application case. These casting methods also include, for example, the tilt casting method, the bottom casting method, the side casting method, or the head casting method, whereby here again, one or more of these casting methods can be advantageous, depending on the application case.

The aforementioned task is accomplished by a system and a method, according to the invention.

A system for casting under pressure, particularly a counter-pressure die-casting system or, in particular, a low-pressure die-casting system, has at least one casting apparatus composed of a lower, hermetically sealable chamber and an upper, preferably hermetically sealable chamber, which are separated from one another by means of an intermediate plate or mold adapter plate. If hermetic sealability of the upper chamber is not important, the chamber can also comprise quasi only a frame, as can particularly be the case for a low-pressure die-casting system. The lower chamber has a furnace with melt or is formed by this. A casting mold divided approximately horizontally is disposed in the upper chamber, which mold consists of a lower casting mold half, which is disposed on the intermediate plate or mold adapter plate, and an upper casting mold half that is disposed underneath an upper, vertically moving support construction, preferably another plate. The upper and/or the lower casting mold half can be formed from individual mold parts. The furnace, with the melt, and the casting mold are connected with one another by way of at least one riser, preferably mounted on the intermediate plate or the mold adapter plate.

According to the invention, it is provided that the upper casting mold half can be pivoted out of the horizontal position into an approximately vertical position, in such a manner that the inside surface of the casting mold half can be treated in work-facilitating and time-saving manner, preferably by a person.

Instead of having to crawl around between the lower casting mold half and the upper casting mold half, in order to carry out cleaning procedures, the application of finish, or corrections on the inside surface of the casting mold half, the person handling this treatment can perform this work with a tremendous time saving, in that the person performs this work while standing in front of the casting apparatus. This leads to a significant increase in productivity.

The same holds true if the lower casting mold half can be pivoted from the horizontal position into an approximately vertical position, in such a manner that the inside surface of the casting mold half can be treated in work-facilitating and time-saving manner, preferably by a person.

Analogously, the invention relates, in general, to a system for casting under pressure, using a permanent casting mold composed of at least two casting mold parts, particularly of two casting mold halves, in which, according to the invention, at least one casting mold part can be pivoted, after the permanent casting mold has been opened, into a position in which the inside surface of this casting mold part can be treated in work-facilitating and time-saving manner, preferably by a person.

The system for casting under pressure, according to the invention, can advantageously be a column casting system.

For specific application cases, it can be advantageous if the system for casting under pressure is a partial vacuum system, particularly a vacuum casting system.

For certain application cases, it can be advantageous if the system for casting under pressure is a counter-pressure die-casting system.

For other application cases, it can be advantageous if the system for casting under pressure is a low-pressure die-casting system.

For some application cases, it can be advantageous if the system for casting under pressure is a gravity die-casting system.

For yet other application cases, it can be advantageous if the system for casting under pressure is a tilt casting system.

For some application cases, it can be advantageous if the system for casting under pressure is a head casting system.

For specific application cases, it can be advantageous if the system for casting under pressure is a bottom casting system.

For many application cases, it can be advantageous if the system for casting under pressure is a side casting system.

It can be practical if the casting mold half can be pivoted about a pivot axis that runs horizontally and runs on the side of the casting apparatus from which the inside surface of the casting mold half is to be treated, preferably by a person.

It can be particularly advantageous if the casting mold half can be pivoted out of the horizontal position by up to 135°, preferably by up to 90°, particularly preferably by up to 85°.

Preferably, the upper casting mold half can be pivoted down. Preferably, the lower casting mold half can be pivoted up.

It can be advantageous if two valves, switched in parallel, are provided, in each instance, for supplying pressure to the lower chamber or the lower pressure space or furnace interior, and, if applicable (for example in the case of a counter-pressure die-casting system), for supplying pressure to the upper chamber or the upper pressure space, by way of corresponding pressure lines, namely a large valve for main filling of the pressure space with pressure medium, and a small valve for a more precise pressure adjustment within the pressure space.

It can be practical to provide a pre-control, in each instance, for regulating each valve, which control can be implemented as a characteristic field or as a mathematical model.

It is advantageous for filling the pressure spaces if first the small valve is opened to about 40 to 60%, preferably to about 45 to 55%, particularly preferably to about 50%, then the reference value from the pre-control, corrected by the pre-set through-flow of the small valve, is applied to the large valve, and finally, the pressure is regulated precisely, using the small valve.

Greater productivity can be achieved by means of a pressure supply configured in this manner, and the regulation quality can be clearly improved.

It can furthermore be advantageous if two casting apparatuses, particularly two column casting apparatuses or machines, are provided, which are disposed at a distance next to one another, wherein a manipulator for handling work pieces or tools of the two casting apparatuses is disposed between the casting apparatuses. Suitable manipulators are known to a person skilled in the art. The arrangement according to the invention leads to an increased degree of automation and to a measurable increase in productivity.

In order to increase productivity, a rail system can be provided, on which at least one carriage is disposed, for fully automated pickup or removal, and fully automated discharge or transfer of a furnace, which carriage moves back and forth between the at least one casting apparatus and a readiness position situated at a distance from it, in such a manner that the carriage picks up a furnace at the readiness position and transfers it to the casting apparatus not yet provided with a furnace, or that the carriage removes a furnace from the casting apparatus and discharges it at a free location of the readiness position, particularly for recharging with melt. This embodiment leads to the result that change-over times of about 8 hours can surprisingly be shortened to only 15 minutes.

It is practical if a rail system is provided on which at least one carriage is disposed, for fully automated pickup or removal and fully automated discharge or transfer of a casting mold or casting mold half, which carriage moves back and forth between the at least one casting apparatus and a readiness position situated at a distance from it, in such a manner that the carriage picks up a casting mold or casting mold half at the readiness position and transfers it to the casting apparatus not yet provided with a casting mold or casting mold half, or that the carriage removes a casting mold or casting mold half from the casting apparatus and discharges it at a free location of the readiness position, for further use, particularly for temporary storage or for replacement. Here again, change-over times are significantly shortened. The degree of automation is increased, and the productivity of the system is increased.

It is practical if the carriage is configured in such a manner that multiple, preferably two furnace positioning locations disposed next to one another, are provided for fully automated pickup or removal and fully automated discharge or transfer of the furnaces. In place of a carriage having multiple furnace positioning locations, multiple carriages each having one furnace positioning location can also be coupled with one another. A combination of at least one carriage having multiple furnace positioning locations and at least one carriage having one furnace positioning location is also possible. The following result is supposed to be achieved: When multiple, preferably two furnace positioning locations are present in the carriage, the possibility exists, on the path between a readiness position and the casting apparatus, in time-saving manner, of taking along a furnace provided with melt, in a furnace positioning location of the carriage, picking up another, particularly empty furnace, from the casting apparatus, in a second furnace positioning location of the carriage, which is still free, subsequently transferring the furnace provided with melt, from the first furnace positioning location to the casting apparatus that does not have a furnace, in order to finally take along the other, particularly empty furnace that has already been picked up, in time-saving manner, on the path between casting apparatus and readiness position, so that the latter can be transferred to a free location of the readiness position for further use, particularly for recharging with melt.

This embodiment leads to the result that change-over times can be shortened even further.

It is advantageous if the carriage is configured in such a manner that multiple, preferably two mold positioning locations disposed next to one another, are provided for fully automated pickup or removal and fully automated discharge or transfer of the casting molds or casting mold halves. In place of a carriage having multiple mold positioning locations, multiple carriages each having one mold positioning location can also be coupled with one another. A combination of at least one carriage having multiple mold positioning locations and at least one carriage having one mold positioning location is also possible. The following result is supposed to be achieved: When multiple, preferably two mold positioning locations are present in the carriage, the possibility exists, on the path between a readiness position and the casting apparatus, in time-saving manner, of taking along a new casting mold or casting mold half, in a mold positioning location of the carriage, picking up a worn-out casting mold or casting mold half from the casting apparatus, in a second mold positioning location of the carriage, which is still free, subsequently transferring the new casting mold or casting mold half from the first mold positioning location to the casting apparatus that does not have a casting mold or casting mold half, in order to finally take along the worn-out casting mold or casting mold half that has already been picked up, in time-saving manner, on the path between casting apparatus and readiness position, so that the latter can be transferred to a free location of the readiness position for further use. This embodiment leads to the result that change-over times can be shortened even further.

It can be advantageous if the carriage has at least two levels, wherein a lower level is provided for fully automated pickup or removal and fully automated discharge or transfer of the furnace, and an upper level is provided for fully automated pickup or removal and fully automated discharge or transfer of the casting mold or casting mold half. In this way, change-over of the furnace and change-over of the casting mold can take place in parallel. Furthermore, it is advantageous that only one carriage is required for both types of change-over.

It is advantageous if the level can be moved in the horizontal and/or the vertical direction.

For specific application cases, it can be advantageous if the rail system is counter-sunk into the ground. For specific other application cases, however, it can also be advantageous if the rail system is positioned on the ground.

It can be advantageous if the intermediate plate or mold adapter plate has predetermined tempering channels, preferably cooling channels, whereby these end in connectors disposed on the intermediate plate or mold adapter plate, preferably in the edge region, for tempering lines disposed outside of the casting apparatus, particularly for cooling lines. In this way, the tempering lines do not hinder the change-over of the casting mold or of the furnace.

Furthermore, in this way, as compared with the state of the art, it is possible to do without an additional cooling plate or a so-called cooling stone, which was disposed between intermediate plate or mold adapter plate and the lower casting mold half or casting mold, according to the state of the art. The additional cooling plate has the purpose, according to the state of the art, of conducting cooling media, particularly cooling water or cooling air, from the outside into the upper chamber and, accordingly, to the casting mold. Tempering of the casting mold can be better controlled by moving the tempering channels, preferably cooling channels, to the intermediate plate or mold adapter plate, on which the casting mold or the lower casting mold half is mounted directly. At the same time, because of the elimination of the additional cooling plate, the chamber volume can be better utilized and the operational reliability of the casting apparatus can be improved, because fewer sealing locations occur. In this way, the seal tightness of the cooling system is optimized.

A further increase in productivity is achieved by means of an increase in the useful lifetime of the intermediate plate or mold adapter plate provided with tempering channels, in that the inside surfaces of the tempering channels can be nickel-plated. This particularly leads to increased corrosion protection.

It can be practical if each tempering line, particularly cooling line, can be individually controlled, particularly time-controlled.

The invention furthermore relates to a pressure-casting method, preferably a counter-pressure die-casting method and/or a low-pressure die-casting method, in which the melt is conveyed through a riser, under the effect of a pressure difference, from a furnace situated in a hermetically sealed chamber, and fills the cavity of a casting mold that is disposed in another, preferably hermetically sealed chamber, where the cast piece solidifies and whereupon it is removed from the casting mold, preferably by means of a manipulator, wherein after removal of the cast piece, preparation for a new casting cycle follows, in that the upper casting mold half is pivoted out of a horizontal position, in such a manner that the inside surface of the casting mold half is treated in work-facilitating and time-saving manner, preferably cleaned, coated and/or corrected, preferably by a person.

Accordingly, the invention relates, in general, to a pressure-casting method, in which a melt is introduced into the cavity of a permanent casting mold, under the effect of a pressure, in which cavity the cast piece solidifies and whereupon it is removed from the permanent casting mold, preferably at least with the involvement of a manipulator, wherein after removal of the cast piece, preparation for a new casting cycle follows, in that at least one casting mold part, particularly a casting mold half, is pivoted, after the permanent casting mold has been opened, into a position in which the inside surface of this casting mold part is treated in work-facilitating and time-saving manner, preferably cleaned, coated and/or corrected, preferably by a person.

It can be advantageous if after removal of the cast piece, preparation for a new casting cycle follows, in that—with reference to other preparation steps—at the same time, before, or afterward, the lower casting mold half is pivoted out of a horizontal position, in such a manner that the inside surface of the casting mold half can be treated in work-facilitating and time-saving manner, preferably cleaned, coated and/or corrected, preferably by a person.

It can be practical if after removal of the cast piece, preparation for a new casting cycle follows, in that—with reference to other preparation steps—at the same time, before, or afterward, the casting mold half is pivoted about a pivot axis that runs horizontally and runs on the side of the casting apparatus from which the inside surface of the casting mold half is supposed to be treated, preferably by a person.

It can be advantageous if after removal of the cast piece, preparation for a new casting cycle follows, in that—with reference to other preparation steps—at the same time, before, or afterward, the casting mold half is pivoted by up to 135°, preferably by up to 90°, particularly preferably by up to 85°.

It can be advantageous if after removal of the cast piece, preparation for a new casting cycle follows, in that—with reference to other preparation steps—at the same time, before, or afterward, the upper casting mold half is pivoted downward and/or the lower casting mold half is pivoted upward.

It is practical that the pressure supply to the lower chamber or to the lower pressure space or furnace interior and, it applicable, the pressure supply to the upper chamber or the upper pressure space, can take place by way of pressure lines having two valves switched in parallel, in each instance, namely by way of a large valve for main filling of the pressure space, and by way of a small valve for a precise pressure adjustment within the pressure space. The regulations of the valves work with a pre-control, in each instance, which is implemented as a characteristic field or as a mathematical model, whereby for filling the pressure spaces, first the small valve is opened to about 40 to 60%, preferably to about 45 to 55%, particularly preferably to about 50%, then the reference value from the pre-control, corrected by the pre-set through-flow of the small valve, is applied to the large valve, and finally, the pressure is regulated precisely, using the small valve.

Greater productivity can be achieved by means of a pressure supply controlled in this manner, and the regulation quality can be clearly improved.

It can be advantageous if after removal of the cast piece, preparation for a new casting cycle follows, in that—with reference to other preparation steps—at the same time, before, or later, a furnace is removed from the casting apparatus by means of a carriage that can move on a rail system, then conveyed to a readiness position, and there discharged at a free location, particularly for recharging with melt, and that directly subsequently, a furnace that has already been made available and is provided with melt is picked up by the carriage, conveyed to the casting apparatus, and transferred to the casting apparatus.

A further development of the invention can provide that the carriage has more than one, preferably two furnace positioning locations, so that in order to replace a furnace disposed in the casting apparatus with a furnace filled with melt, the carriage first picks up the furnace filled with melt, in its first furnace positioning location, subsequently moves to the casting apparatus, with the furnace situated in its first furnace positioning location, there picks up the one furnace in its second furnace positioning location, which is still free, subsequently transfers the furnace provided with melt from the first furnace positioning location to the casting apparatus that does not have a furnace, and finally takes along the empty furnace that has already been picked up, on its way back to the readiness position, so that this furnace can be transferred to a free location of the readiness position, particularly for recharging with melt. This embodiment leads to the result that change-over times can be shortened even further.

It is practical that after removal of the cast piece, preparation for a new casting cycle can follow, in that—with reference to other preparation steps—at the same time, before, or later, a casting mold or casting mold half is removed from the casting apparatus by means of a carriage that moves on a rail system, then conveyed to a readiness position, and there discharged at a free location, particularly for temporary storage or for replacement, and that directly subsequently, a casting mold or casting mold half that has already been made available is picked up by the carriage, conveyed to the casting apparatus, and transferred to the casting apparatus.

A further development of the invention can provide that the carriage has more than one, preferably two mold positioning locations, so that in order to replace a worn-out casting mold or casting mold half of the casting apparatus with a new casting mold or casting mold half, the carriage first picks up the new casting mold or casting mold half in its first mold positioning location, then moves to the casting apparatus, there picks up the worn-out casting mold or casting mold half in its second mold positioning location, which is still free, subsequently transfers the new casting mold or casting mold half from its first mold positioning location to the casting apparatus that is not provided with a casting mold or casting mold half, and finally takes along the worn-out casting mold or casting mold half that has already been picked up, on its way back, for further use. This embodiment leads to the result that change-over times can be shortened even further.

For specific cases of use, it can be practical if the pressure-casting method is a partial vacuum casting method, preferably a vacuum casting method.

For other cases of use, it can be practical if the pressure-casting method is a gravity casting method, particularly a tilt casting method.

For some cases of use, it can be advantageous if the pressure-casting method is a bottom casting method.

For some cases of use, it can be advantageous if the pressure-casting method is a side casting method.

For certain cases of use, it can be advantageous if the pressure-casting method is a head casting method.

The invention furthermore relates to the use of a system, preferably a counter-pressure die-casting system, and/or of a method, for the production of components from the application sector of chassis casting, specifically of wheel-guiding components, particularly suspension links, longitudinal suspension links, transverse suspension links, corner castings, node castings, frames, etc., of wheel-carrying components, particularly swivel bearings, wheel mounts, axle journals, of injection pump housings, or the like.

It can be advantageous to use a system, preferably a counter-pressure die-casting system, and/or a method, preferably a counter-pressure die-casting method, for the production of high-stress safety components, preferably of rims, of engine components, particularly of engine blocks, intake manifolds, or crankcases, of pressure-resistant components, of injection pump housings, or the like.

The invention also relates to the use of a low-pressure die-casting system and/or of a low-pressure die-casting method for the production of components from the application sector of chassis casting, specifically of wheel-carrying components, particularly swivel bearings, wheel mounts, axle journals, of injection pump housings, or the like.

It can also be practical to use a low-pressure die-casting system and/or a low-pressure die-casting method for the production of chassis parts, preferably of wheel-guiding components, particularly suspension links, longitudinal suspension links, transverse suspension links, corner castings, node castings, frames, or the like, or of high-stress safety components, preferably of rims, of engine components, particularly of engine blocks, intake manifolds, or crankcases, of pressure-resistant components, of injection pump housings, or the like.

The invention furthermore relates to the use of a system, particularly a counter-pressure die-casting system or a low-pressure die-casting system, and/or of a low-pressure die-casting method, for the production of chassis components or safety components from light metal or a light-metal alloy, particularly preferably from aluminum or an aluminum alloy.

Furthermore, the invention relates to a component from the application sector of chassis casting, specifically a wheel-guiding component, particularly suspension link, longitudinal suspension link, transverse suspension link, corner casting, node casting, frame, etc., a wheel-carrying component, particularly swivel bearing, wheel mount, axle journal, an injection pump housing, or the like, which is produced, in each instance, using a system, preferably a counter-pressure die-casting system, and/or a method, preferably a counter-pressure die-casting method.

Finally, the invention relates to a component from the application sector of chassis casting, specifically a wheel-carrying component, particularly swivel bearing, wheel mount, axle journal, an injection pump housing, or the like, which is produced, in each instance, using a low-pressure die-casting system and/or a low-pressure die-casting method.

Figure 2:
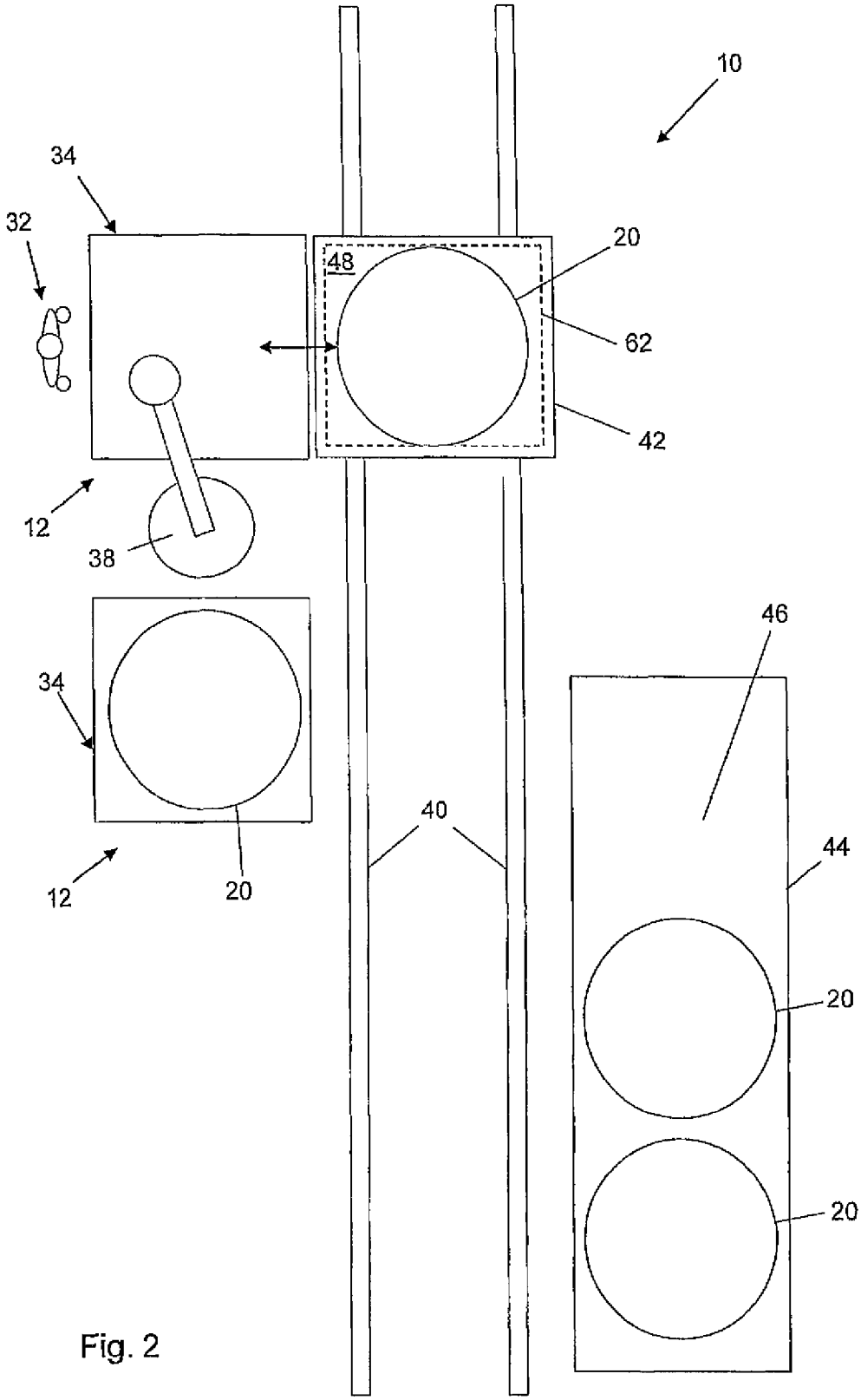
Figure 3:
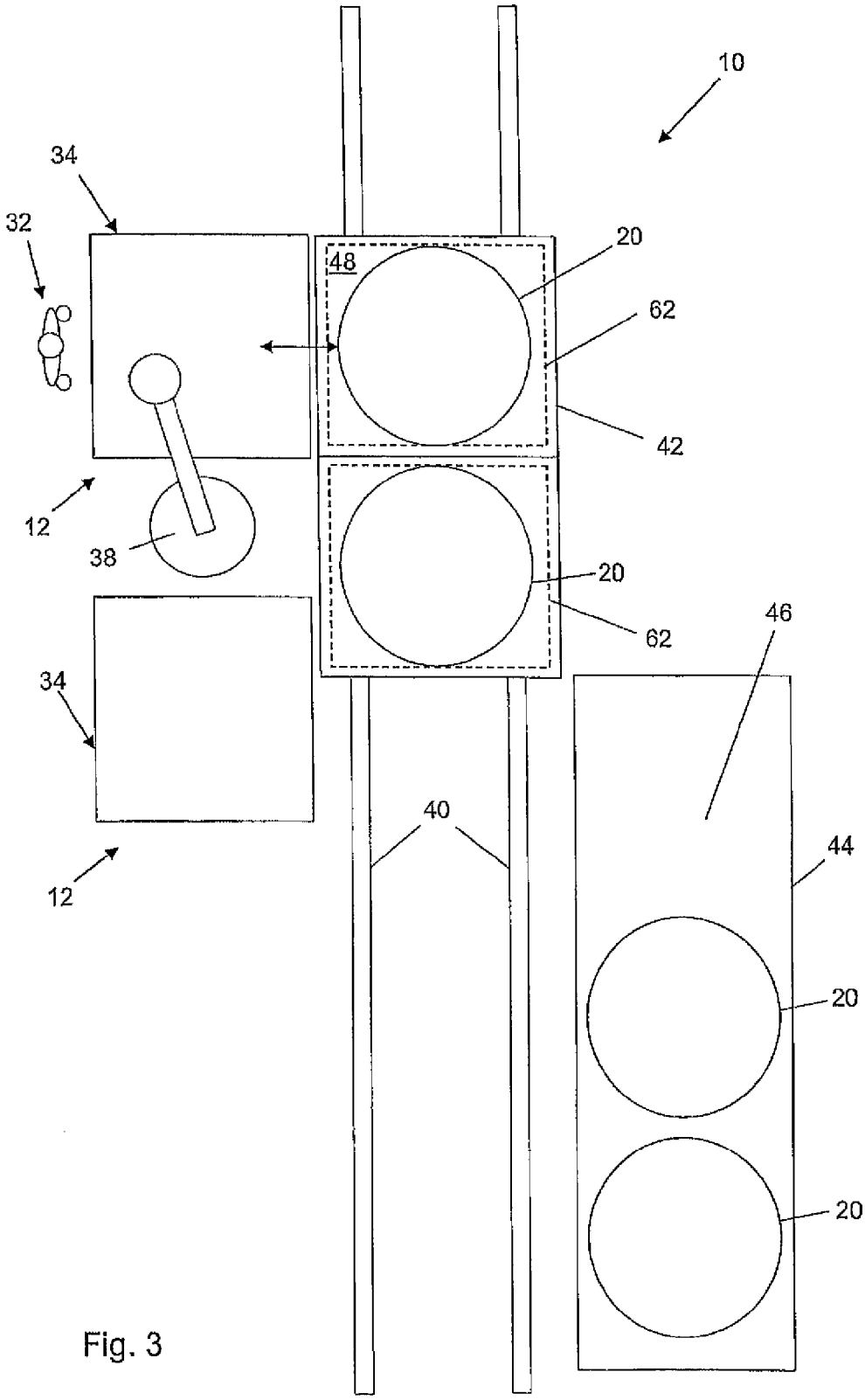

Further details of the invention are evident from the following description, in combination with the drawing. In this drawing, the figures show:

FIG. 1 schematically, in a side view, a casting apparatus according to the invention, FIG. 2 schematically, in a top view, a system according to the invention, and FIG. 3 schematically, in a top view, a second system according to the invention.

When the same reference symbols are used in FIGS. 1 to 3, these refer to the same parts or region.

The counter-pressure die-casting system 10 shown schematically in FIG. 2 comprises two casting apparatuses 12 disposed at a distance next to one another. Such a casting apparatus is shown schematically in FIG. 1.

The casting apparatus 12 has a lower, hermetically sealable chamber 14, and an upper, hermetically sealable chamber 16, which are separated from one another by means of an intermediate plate or mold adapter plate 18.

A furnace 20, which has a crucible 56 with melt 22, is provided in the lower chamber 14.

A casting mold divided approximately horizontally is disposed in the upper chamber 16, whereby this mold consists of a lower casting mold half 24 that is disposed on the intermediate plate or mold adapter plate 18, and an upper casting mold half 26 that is disposed underneath an upper, vertically movable support construction 28, for example a further plate. This support construction 28 furthermore has a type of hood 58 that is set down on the intermediate plate or mold adapter plate 18, to form the hermetically sealed upper chamber 16, when the support construction 28 is moved vertically downward.

FIG. 1 shows a casting apparatus 12 in a state in which the casting mold is open and thus the hood 58 is lifted off the intermediate plate or mold adapter plate 18.

The furnace 20 or crucible 56, provided with melt 22, and the casting mold cavity formed by the two casting mold halves 24, 26, in the closed state, are connected with one another by way of a riser 30 that is mounted on the intermediate plate or mold adapter plate 18.

The upper casting mold half 26 can now be pivoted, according to the invention, from the horizontal position, for example by about 85°, downward, into an approximately vertical position, whereby the inside surface of the casting mold half 26 would face a person 32 viewing FIG. 1. A person 32, who then stands in front of the casting apparatus 12, preferably approximately at the height of the intermediate plate or mold adapter plate 18, can then treat the casting mold half 26 in particularly simple manner, particularly clean it, coat it, and/or correct it.

In FIG. 1, bearings 60 and a pivot axis 36 are shown purely schematically; these are intended to illustrate the ability of the upper casting mold half 26 to pivot. Preferably, force cylinders suitable for pivoting the upper casting mold half 26 are provided; they are not shown here.

According to the invention, a manipulator 38 for handling work pieces or tools or casting molds or casting mold halves of the two casting apparatuses is disposed between the two casting apparatuses 12 disposed next to one another, at a distance, in FIG. 2.

A rail system 40 is provided on the rear side of the two casting apparatuses 12; a carriage 42 is disposed on this system, for fully automated pickup or removal and fully automated discharge or transfer of a furnace 20.

In this connection, the carriage 42 moves back and forth between the casting apparatuses 12 and a readiness position 44 that lies at a distance from them.

In FIG. 2, it is shown how the carriage 42 stops in front of a casting apparatus 12, in order to transfer a furnace 20 filled with melt from its furnace positioning location 62 into the casting apparatus 12, which is not yet provided with a furnace 20, whereby for this purpose, the level 48 is moved into this casting apparatus. Before that, the carriage 42 picked up this furnace, leaving a free location 46 at the readiness position 44.

In FIG. 3, the carriage has a further furnace positioning location 62 as compared with the carriage shown in FIG. 1. In this way, a time-saving exchange of an empty furnace disposed in the casting apparatus for a furnace filled with melt is possible. The carriage 42 first picks up the furnace filled with melt, in a first furnace positioning location 62, from the readiness position 44, subsequently moves to the casting apparatus 12, in order to there pick up the empty furnace in a second furnace positioning location 62, which is still free, subsequently transfers the furnace provided with melt from the first furnace positioning location 62 to the casting apparatus 12 that does not have a furnace, in order to finally take along the empty furnace that has already been picked up, to the readiness position 44, so that this furnace can be transferred to a free location 46 of the readiness position 44, for recharging with melt.

The connectors 52 disposed on the intermediate plate or mold adapter plate 18, preferably in the edge region, which are connected on the one side with the tempering channels 50 that are provided in the intermediate plate or mold adapter plate 18, and, on the other side, with the tempering lines 54, particularly cooling lines, that are disposed outside of the casting apparatus 12, represent more than just a facilitation for change-over of the casting apparatus 12, whereby these tempering lines do not stand in the way of replacement of the casting mold or casting mold halves 24, 26.

Instead, it is possible to do without an additional cooling plate or a so-called cooling stone, which is required according to the state of the art, and was disposed between intermediate plate or mold adapter plate 18 and the lower casting mold half or casting mold 24 according to the state of the art, by means of the tempering channels 50 disposed in the intermediate plate or mold adapter plate 18. By means of laying the tempering channels 50, preferably cooling channels, in the intermediate plate or mold adapter plate 18, on which the casting mold or the lower casting mold half 24 can be mounted directly, tempering of the casting mold 24 can be controlled significantly better. At the same time, the upper chamber volume can be better utilized, by means of elimination of the additional cooling plate, and the operational safety of the casting apparatus 12 can be improved, because there are fewer sealing locations. The sealability of the cooling system, as a whole, is optimized.

REFERENCE SYMBOL LIST (is part of the specification)

10 system
12 casting apparatus
14 chamber
16 chamber
18 intermediate plate or mold adapter plate
20 furnace
22 melt
24 lower casting mold half
26 upper casting mold half
28 support construction
30 riser
32 person
34 side
36 pivot axis
38 manipulator
40 rail system
42 carriage
44 readiness position
46 free location
48 lower level

50 tempering channels
52 connector location
54 tempering lines
56 crucible
58 hood
60 storage area
62 furnace positioning location

The invention claimed is:

1. A system for casting under pressure, using a permanent casting mold composed of at least first and second casting mold parts, wherein at least the first casting mold part is pivoted, after the permanent casting mold has been opened, into a position in which the inside surface of the first casting mold part is treated in work-facilitating and time-saving manner, the system further comprising at least one casting apparatus, a rail system, and at least one carriage disposed on the rail system, for fully automated pickup or removal, and fully automated discharge or transfer of a furnace, wherein the carriage moves back and forth between the at least one casting apparatus and a readiness position situated at a distance from the at least one casting apparatus, in such a manner that the carriage picks up the furnace at the readiness position and transfers the furnace to the at least one casting apparatus, or that the carriage removes the furnace from the at least one casting apparatus and discharges the furnace at a free location of the readiness position.

2. The system according to claim 1, further comprising at least one casting apparatus composed of a lower, hermetically sealable chamber and an upper, hermetically sealable chamber, which are separated from one another by an intermediate plate or mold adapter plate, wherein the lower chamber has a furnace with melt, wherein the casting mold is divided approximately horizontally and is disposed in the upper chamber, wherein the first casting mold part is an upper casting mold half that is disposed underneath an upper, vertically movable support construction and the second casting mold part is a lower casting mold half, which is disposed on the intermediate plate or mold adapter plate, wherein the furnace with the melt, and the casting mold are connected with one another by way of at least one riser, mounted on the intermediate plate or the mold adapter plate, wherein the upper casting mold half is pivoted out of the horizontal position into an approximately vertical position, in such a manner that the inside surface of the upper casting mold half is treated in work-facilitating and time-saving manner.

3. The system according to claim 2, wherein the system is a column casting system.

4. The system according to claim 2, wherein the system is a partial vacuum casting system.

5. The system according to claim 2, wherein the system is a gravity die-casting system.

6. The system according to claim 2, wherein the system is a tilt casting system.

7. The system according to claim 2, wherein the lower casting mold half is pivoted out of the horizontal position into an approximately vertical position, in such a manner that the inside surface of the lower casting mold half is treated in work-facilitating and time-saving manner.

8. The system according to claim 2, wherein the upper casting mold half is pivoted about a pivot axis that runs horizontally and runs on the side of the casting apparatus from which the inside surface of the upper casting mold half is to be treated.

9. The system according to claim 2, wherein the upper casting mold half is pivoted by up to 135°C.

10. The system according to claim 2, wherein the upper casting mold half is pivoted down.

11. The system according to claim 2, wherein the lower casting mold half is pivoted up.

12. The system according to claim 2, wherein first and second casting apparatuses are provided, which are disposed adjacent one another, wherein a manipulator for handling work pieces or tools of the two casting apparatuses is disposed between the casting apparatuses.

13. The system according to claim 2, wherein a first and a second valve, switched in parallel, are provided, in each instance, for supplying pressure to the lower chamber or the lower pressure space or furnace interior, and, if applicable, for supplying pressure to the upper chamber or the upper pressure space, the first valve being for main filling of the pressure space, and the second valve being for a more precise pressure adjustment within the pressure space, wherein the first valve is larger than the second valve.

14. The system according to claim 13, wherein a pre-control is provided, in each instance, for regulating each valve, which control is implemented as a characteristic field or as a mathematical model.

15. The system according to claim 2, wherein the intermediate plate or mold adapter plate has predetermined tempering channels that end in connectors disposed on the intermediate plate or mold adapter plate for tempering lines disposed outside of the at least one casting apparatus.

16. The system according to claim 15, wherein each tempering line is individually controlled.

17. The system according to claim 1, wherein the system is a counter-pressure die-casting system or low-pressure die-casting system.

18. The system according to claim 1, wherein the carriage has at least two furnace positioning locations disposed next to one another, for fully automated pickup or removal, and for fully automated discharge or transfer of furnaces.

19. The system according to claim 1, wherein the carriage has at least two levels, wherein a lower level is provided for fully automated pickup or removal, and for fully automated discharge or transfer of the furnace, and an upper level is provided for fully automated pickup or removal, and for fully automated discharge or transfer of the casting mold or casting mold part.

20. The system according to claim 19, wherein the lower level is moved in the horizontal and/or in the vertical direction.

21. A system for casting under pressure, using a permanent casting mold composed of at least first and second casting mold parts, wherein at least the first casting mold part is pivoted, after the permanent casting mold has been opened, into a position in which the inside surface of the first casting mold part is treated in work-facilitating and time-saving manner, the system further comprising at least one casting apparatus, a rail system, and at least one carriage disposed on the rail system, for fully automated pickup or removal and fully automated discharge or transfer of a casting mold or casting mold part, wherein the carriage moves back and forth between the at least one casting apparatus and a readiness position situated at a distance from the at least one casting apparatus, in such a manner that the carriage picks up the casting mold or casting mold part at the readiness position and transfers the casting mold or casting mold part to the at least one casting apparatus, or that the carriage removes a casting mold or casting mold part from the at least one casting apparatus and discharges the casting mold or casting mold part at a free location of the readiness position, for further use.

22. The system according to claim 21, wherein the carriage has at least two mold positioning locations disposed next to one another, for fully automated pickup or removal, and for fully automated discharge or transfer of casting molds or casting mold parts.

23. A system for casting under pressure, comprising a permanent casting mold composed of at least first and second casting mold parts, wherein at least the first casting mold part is pivoted, after the permanent casting mold has been opened, into an interior treatment position, an inside surface of the first casting mold part being treatable in work-facilitating and time-saving manner in the interior treatment position of the first casting mold part, wherein when the first casting mold part is in the interior treatment position, a mold opening of the first casting mold part is disposed at a first lateral side of the permanent casting mold and the mold opening is open towards an outside of the permanent casting mold, wherein the first casting mold part is an upper casting mold half that is pivoted about a pivot axis running horizontally and running on the first lateral side of the permanent casting mold and wherein during pivoting of the upper casting mold half to the interior treatment position, the underside forming the cast piece or the inner surface of the upper casting mold half leads the backside of the upper casting mold half.

24. A system for casting under pressure, comprising a permanent casting mold composed of at least first and second casting mold parts, wherein at least the first casting mold part is pivoted, after the permanent casting mold has been opened, into an interior treatment position, an inside surface of the first casting mold part being treatable in work-facilitating and time-saving manner in the interior treatment position of the first casting mold part, wherein when the first casting mold part is in the interior treatment position, a mold opening of the first casting mold part is disposed at a first lateral side of the permanent casting mold and the mold opening is open towards an outside of the permanent casting mold, wherein the first casting mold part is a lower casting mold half that is pivoted about a pivot axis running horizontally and running on the first lateral side of the permanent casting mold, wherein the lower casting mold part is pivoted up, and wherein during pivoting of the lower casting mold half to the interior treatment position, the upper side forming the cast piece or inner surface of the lower casting mold half leads the backside of the lower casting mold half.

* * * * *

UNITED STATES PATENT AND TRADEMARK OFFICE

CERTIFICATE OF CORRECTION

PATENT NO. : 8,783,331 B2
APPLICATION NO. : 13/382598
DATED : July 22, 2014
INVENTOR(S) : Heinecke et al.

It is certified that error appears in the above-identified patent and that said Letters Patent is hereby corrected as shown below:

In the Claims:

Column 11, line 65 (Line 2 of Claim 9), please change "135°C" to correctly read: --135°--.

Signed and Sealed this
Seventh Day of October, 2014

Michelle K. Lee

Michelle K. Lee
*Deputy Director of the United States Patent and Trademark Office*